US008221653B2

(12) United States Patent
Aoyama et al.

(10) Patent No.: US 8,221,653 B2
(45) Date of Patent: Jul. 17, 2012

(54) COMPOSITION OF CONDUCTIVE RUBBER

(75) Inventors: Takashi Aoyama, Hitachi (JP); Iwao Watanabe, Takahagi (JP)

(73) Assignee: Hitachi Cable, Ltd., Tokyo (JP)

( * ) Notice: Subject to any disclaimer, the term of this patent is extended or adjusted under 35 U.S.C. 154(b) by 264 days.

(21) Appl. No.: 12/694,582

(22) Filed: Jan. 27, 2010

(65) Prior Publication Data

US 2011/0049436 A1 Mar. 3, 2011

(30) Foreign Application Priority Data

Sep. 3, 2009 (JP) ..... 2009-203763

(51) Int. Cl.
*H01B 1/06* (2006.01)
*H01B 7/18* (2006.01)

(52) U.S. Cl. ..... 252/511; 174/102 R

(58) Field of Classification Search ..... 252/502; 174/102 R
See application file for complete search history.

(56) References Cited

U.S. PATENT DOCUMENTS 4,412,938 A * 11/1983 Kakizaki et al. ..... 252/511
6,395,989 B2 * 5/2002 Lecoeuvre et al. ..... 174/120 SC
6,491,849 B1 * 12/2002 Easter ..... 252/511
6,972,099 B2 * 12/2005 Easter ..... 252/511

FOREIGN PATENT DOCUMENTS

JP 61293241 A * 12/1986
JP 07-126439 5/1995
JP 10-030059 2/1998

* cited by examiner

*Primary Examiner* — Mark Kopec
*Assistant Examiner* — Jaison Thomas
(74) *Attorney, Agent, or Firm* — Scully, Scott, Murphy & Presser, P.C.

(57) ABSTRACT

A composition of conductive rubber which does not adhere each other in uncross-linked state is provided to exhibit good workability. The composition of conductive rubber including carbon as conductive additive in a base rubber to be cross-linkable by electron beam radiation includes 5 to 40% by weight of an adhesion inhibitor of uncross-linked rubber into a base rubber which is selected from ethylene ethyl acrylic acid copolymer resin (EEA), ethylene vinyl acetate copolymer resin (EVA), ethylene methyl acrylate copolymer resin (EMA), and ethylene acrylic acid copolymer resin (EAA).

3 Claims, 1 Drawing Sheet

COMPOSITION OF CONDUCTIVE RUBBER

The present application is based on Japanese Patent Application No. 2009-203763 filed on Sep. 3, 2009, the entire contents of which are incorporated herein by reference.

BACKGROUND OF THE INVENTION

1. Field of the Invention

The present invention relates to a composition of conductive rubber used for a conductive member like a cord switch, etc.

2. Related Art

Generally, a type of a composition of conductive rubber of adding conductive additive like carbon, etc. into a base rubber is used as a composition of conductive rubber applied for electromagnetic shield, static elimination, electrodes of a pressure sensitive switch, etc. As such a conductive rubber, for example, acrylonitrile butadiene rubber (NBR) to which carbon is added for the conductive additive is proposed by e.g. Japanese Patent Laid-Open No. 7-126439 (JP-A 7-126439) and silicon rubber to which carbon is added is also proposed by e.g. Japanese Patent Laid-Open No. 10-30059 (JP-A 10-30059).

As methods for crosslinking the composition of conductive rubber, there are sulfur cross-linkage, peroxide cross-linkage, cross-linkage by electron beam radiation and the like. In the abovementioned methods, when a sheet, etc. are extruded to be molded, an extrusion process temperature should be set in a range that cross-linkage does not occur, because the sulfur cross-linkage or the peroxide cross-linkage occurs by thermal trigger.

On the other hand, the cross-linkage by electron beam radiation has a feature by which molding at a high temperature is capable, because the cross-linkage by electron beam radiation is performed by radiation of electron beam to a molded body so that the cross-linkage does not occur in an extrusion molding apparatus not to cause defective in shape.

Especially, when there is a need to reduce a volume resistance of a composition of conductive rubber, a large amount of conductive additive like carbon, etc. should be added to the composition of conductive rubber, so that the composition of conductive rubber becomes high in viscosity and bad in workability. For this reason, the cross-linkage by electron beam radiation, in which molding can be carried out even in a state of low viscosity at a high temperature, is effective for cross-linking the composition of conductive rubber which has a low volume resistance.

When the cross-linkage by the electron beam radiation is used for a cross-linkage method, the cross-linkage by the electron beam radiation is carried out in many cases at a separate stage after a metallic molding or an extrusion molding, etc. This is because a cross-linkage apparatus by electron beam radiation is very expensive and difficult to be set into those molding processes.

For this reason, when molded bodies such as uncross-linked sheets which are formed by metallic molding or extrusion molding, etc, are moved to a following stage for electron beam radiation cross-linkage, there is a case where the molded bodies are piled up or wound in many turns around a bobbin. However, there is a problem in which the molded bodies are adhered each other to be stuck one on another because of uncross-linkage of conductive rubber.

SUMMARY OF THE INVENTION

Accordingly, it is an object of the present invention to solve the abovementioned problem, and provide a composition of conductive rubber, which is to be cross-linked by electron beam radiation and which is not adhered each other even in uncross-linked state to provide good workability.

The present invention is devised to realize the abovementioned object and is of a composition of conductive rubber including base rubber added with carbon as conductive additive, and further comprising 5 to 40% by weight of an adhesion inhibitor of uncross-linked rubber which includes any of ethylene ethyl acrylic acid copolymer resin (EEA), ethylene vinyl acetate copolymer resin (EVA), ethylene methyl acrylate copolymer resin (EMA), and ethylene acrylic acid copolymer resin (EAA) in a composition of conductive rubber to be cross-linkable by electron beam radiation.

It is preferred that a content of ethylene in the adhesion inhibitor of the uncross-linked rubber is equal to or more than 70% by weight.

It is preferred that a melt flow rate of the adhesion inhibitor of the uncross-linked rubber is equal to or more than 5.

ADVANTAGES OF THE INVENTION

According to this invention, a composition of conductive rubber having no problem of adhering each other can be provided to result in good workability, in a composition of conductive rubber to be cross-linkable by electron beam radiation.

BRIEF DESCRIPTION OF THE DRAWINGS

Next, the present invention will be explained in more detail in conjunction with appended drawings, wherein.

DESCRIPTION OF THE PREFERRED EMBODIMENTS

Figure 1:
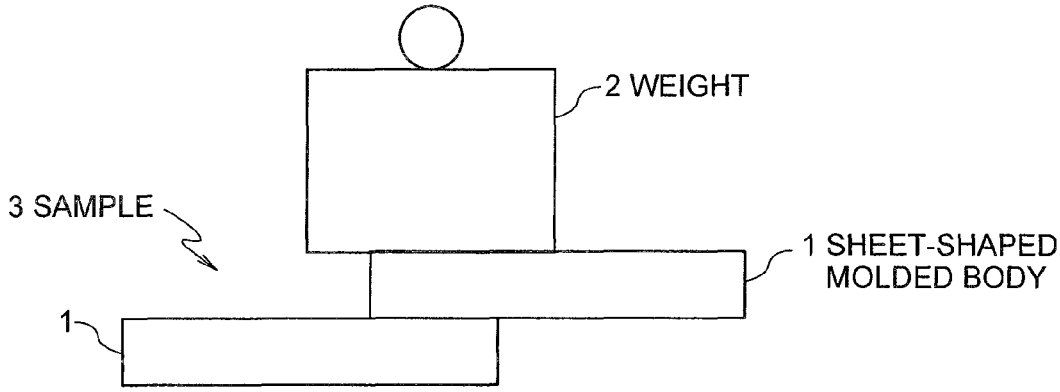
FIG. 1 is a schematic view explaining a method of fabricating samples for evaluation of adhesion between the two samples fabricated from a composition of conductive rubber in the invention.

Next, preferred embodiments of the invention will be explained below.

A composition of conductive rubber in the embodiment comprises carbon as conductive additive added to base rubber, and further comprising 5 to 40% by weight of an adhesion inhibitor including any of ethylene ethyl acrylic acid copolymer resin (EEA), ethylene vinyl acetate copolymer resin (EVA), ethylene methyl acrylate copolymer resin (EMA), ethylene acrylic acid copolymer resin (EAA) in a composition of conductive rubber to be cross-linked by electron beam radiation.

It is possible to prevent uncross-linked molded bodies from being adhered each other by further addition of the adhesion inhibitor of uncross-linked rubber into the base rubber, because EEA, EVA, EMA, and EAA used for the adhesion inhibitor of uncross-linked rubber are semi-crystalline resins not to be adhered each other even in uncross-linked state.

The reason why the quantity of the addition of EEA, EVA, EMA, and EAA as the adhesion inhibitor of uncross-linked rubber is 5 to 40% by weight is that it is rarely expected to provide an effect of prevention for adhesion among the uncross-linked molded bodies each other in a range less than 5% by weight of the inhibitor, and that characteristics as the composition of conductive rubber are lost in a range more than 40% by weight of the inhibitor. An example of losing those characteristics is that a compression permanent strain becomes large.

It is preferred that a content of ethylene included in EEA, EVA, EMA, and EAA used for the adhesion inhibitor of uncross-linked rubber is equal to or more than 70% by weight. This is because the larger the content of the ethylene is, the larger the crystallinity is, so that the effect of preventing adhesion becomes more effective in a larger content thereof, and because, when the content of the ethylene is less than 70% by weight, the crystallinity becomes less, so that the effect of preventing the adhesion among the uncross-linked extrusion molded bodies each other becomes less.

Furthermore, it is preferred that a melt flow rate of EEA, EVA, EMA, and EAA used for the adhesion inhibitor of uncross-linked rubber is equal to or more than 5. The larger the melt flow rate, which is an index showing fluidity in the melting state, is, the better the fluidity is. When the melt flow rate of the adhesion inhibitor of uncross-linked rubber is less than 5, a viscosity (Mooney viscosity) of the composition of conductive rubber becomes so high, so that the workability becomes bad.

EPDM (Ethylene Propylene Rubber), NBR (Acrylonitrile-Butadiene Rubber), SBR (Styrene-Butadiene Rubber), etc. are listed as a base rubber. The invention is, however, not to be limited to these materials.

Cross-linked conductive rubber is obtained by radiation of electron beam to a molded body which is molded by metallic molding or extrusion molding of the composition of conductive rubber of the embodiment.

In the composition of conductive rubber of the embodiment as described above, 5 to 40% by weight of an adhesion inhibitor including any of EEA, EVA, EMA, and EAA is further included in a base rubber in uncross-linked state for a composition of conductive rubber to be cross-linked by radiation of electron beam.

According to an addition of the adhesion inhibitor of uncross-linked rubber, even uncross-linked molded bodies are not adhered so as to suppress a disadvantage in which the uncross-linked molded bodies are struck each other. Furthermore, because the content of the adhesion inhibitor of the uncross-linked rubber is 5 to 40% by weight, there is no disadvantage in which the characteristics of a composition of conductive rubber are lost, for example, in increase of compressive permanent set.

Furthermore, in the composition of conductive rubber of the embodiment, good workability and low volume resistance can be obtained because of adoption of the cross-linkage by the electron beam radiation.

Furthermore, in the composition of conductive rubber of the embodiment, adhesion among uncross-linked molded bodies can be suppressed, because the content of the ethylene included in the adhesion inhibitor of the uncross-linked rubber is equal to or more than 70% by weight.

Furthermore, in the composition of conductive rubber of the embodiment, because the melt flow rate of the adhesion inhibitor of the uncross-linked rubber is equal to or more than 5, a viscosity (Mooney viscosity) can be low, so that workability is good at molding such as metallic molding or extrusion molding.

EXAMPLES

Examples of the present invention and Comparative Examples will be explained as follows.

TABLE 1 shows contents of ethylene and melt flow rates (JIS K7210, 190° C., 2.16 kg load) of EVA (EVA1 to EVA3) and EEA (EEA1 and EEA2).

TABLE 1

| Item | Content of ethylene (%) | Melt flow rate |
|---|---|---|
| EVA1 | 86 | 15 |
| EVA2 | 72 | 6 |
| EVA3 | 86 | 3.5 |
| EEA1 | 83 | 25 |
| EEA2 | 66 | 25 |

Compositions of conductive rubber for Examples 1 to 8 are prepared by using the adhesion inhibitors of uncross-linked rubber shown in TABLE 1 in accordance with mixing ratios shown in TABLE 2. Furthermore, compositions of conductive rubber for Comparative Examples 1 to 4 are prepared in accordance with mixing ratios shown in TABLE 3.

TABLE 2

| | | EX 1 | EX 2 | EX 3 | EX 4 | EX 5 | EX 6 | EX 7 | EX 8 |
|---|---|---|---|---|---|---|---|---|---|
| Mixing ratios | EP rubber (EPT4021) | 80 | 80 | 80 | 70 | 70 | 70 | 95 | 60 |
| | Carbon (Ketchen black EC600JD) | 25 | 25 | 25 | 25 | 25 | 25 | 25 | 25 |
| | EVA1 | 20 | — | — | — | — | — | 5 | — |
| | EVA2 | — | 20 | — | — | 30 | — | — | — |
| | EVA3 | — | — | 20 | — | — | — | — | — |
| | EEA1 | — | — | — | 30 | — | — | — | 40 |
| | EEA2 | — | — | — | — | — | 30 | — | — |
| Characteristics | Adhesive strength (N) | 8.5 | 9.5 | 8.5 | 8 | 9 | 12 | 14 | 7.5 |
| | Compressive permanent set | 43 | 42 | 43 | 45 | 45 | 44 | 39 | 48 |
| | Mooney viscosity (180° C.) | 110 | 115 | 123 | 105 | 112 | 105 | 120 | 102 |
| | Volume resistance (Ωcm) | 1 | 1 | 1 | 1 | 1 | 1 | 1 | 1 |

TABLE 3

| | Item | Comparative Example 1 | Comparative Example 2 | Comparative Example 3 | Comparative Example 4 |
|---|---|---|---|---|---|
| Mixing ratios | EP rubber (EPT4021) | 98 | 97.5 | 50 | 40 |
| | Carbon (Ketchen black EC600JD) | 25 | 25 | 25 | 25 |
| | EVA 1 | 2 | — | — | — |
| | EVA 3 | — | 2.5 | — | — |
| | EEA 1 | — | — | 50 | — |
| | EEA 2 | — | — | — | 60 |

TABLE 3-continued

| Item | | Comparative Example 1 | Comparative Example 2 | Comparative Example 3 | Comparative Example 4 |
|---|---|---|---|---|---|
| Characteristics | Adhesive strength (N) | 22 | 25 | 7 | 6 |
| | Compressive permanent set | 37 | 38 | 57 | 65 |
| | Mooney viscosity (180° C.) | 122 | 124 | 105 | 100 |
| | Volume resistance (Ωcm) | 1 | 1 | 1 | 1 |

EPT4021 made by Mitsui Chemical Ltd. is used as EP rubber (EPDM) used for base rubber, and Ketchen black EC600JD made by Ketchen Black International Company is used as carbon used for conductive additive.

A sheet-shaped molded body having a thickness of 1 mm is molded at 180° C. by press using the compositions of conductive rubber for the Examples 1 to 8 and Comparative Examples 1 to 4 (uncross-linked state).

Figure 2:
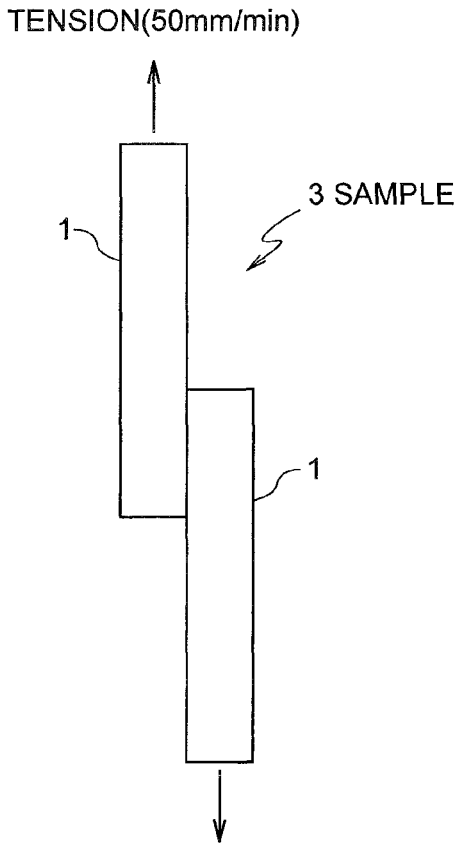
FIG. 2 is a schematic view explaining a method of evaluation of adhesion between the two samples fabricated from a composition of conductive rubber using the samples fabricated in FIG. 1 in the invention.

In order to evaluate adhesion among the compositions of conductive rubber, Sample 3 is prepared as formed in following steps. At first, two pieces of sheet-shaped molded bodies 1 which are cut by 5 mm width and 20 mm length as shown in FIG. 1 are lapped by 5 mm (a contacted area of the both sheet-shaped molded bodies was 5 mm×5 mm), and a weight 2 of 1 kg is put on the lapped surface for 1 hour at 60° C. Then, as shown in FIG. 2, an adhesive strength is measured in a tensile test at a tensile velocity of 50 mm/min using the Sample 3.

Furthermore, Mooney viscosity (JIS K6395, $M_{1+4}$(180° C.)), which is an index of workability, is measured.

Next, a cross-linked conductive rubber sheet is obtained by cross-linking by electron beam radiation (18 Mrad) to the sheet-shaped molded body having a thickness of 1 mm. Then, a compressive permanent set test (JIS K6262, 150° C., 25% compression, left for 22 hours) and a measurement of volume resistance (JIS K7194, 4 terminal-4 probe method) are carried out.

The results of these tests are shown in TABLE 2 and TABLE 3.

Herein, as objective characteristics of a composition of conductive rubber, the evaluations are carried out under criteria, in which an adhesive strength is not equal to or less than 15 N not to cause adhesion in practice and a compressive permanent set is equal to or less than 50.

Referring to TABLE 2, the compositions of conductive rubber in Examples 1 to 8 include 5 to 40% by weight of an adhesion inhibitor of uncross-linked rubber comprising EVA or EEA, so that the adhesive strength is so good to be equal to or less than 15 N, and the compressive permanent sets are so good to be equal to or less than 50.

Compositions of conductive rubber in Examples 4 to 6 include the same content as above, that is, 30% by weight of the adhesion inhibitor of uncross-linked rubber, in which an adhesive strength of Example 6 which is added with EEA2 including 66% of ethylene is 12 N, an adhesive strength of Example 4 which is added with EEA1 including 83% of ethylene is 8 N, and an adhesive strength of Example 5 which is added with EVA2 including 72% of ethylene is 9 N. That is, the adhesive strength of Examples 4 to 6 is equal to or less than 10 N to exhibit very effective values. Therefore, it is preferred that the content of ethylene included in the adhesion inhibitor of uncross-linked rubber is equal to or more than 70%.

Furthermore, while the compositions of conductive rubber in Examples 1 to 3 include the same content as above, that is, 20% by weight of the adhesion inhibitor of uncross-linked rubber, in which Moony viscosity of Example 3 which is added with EVA3 having a melt flow rate of 3.5, is 123, meanwhile both Moony viscosity of Example 1 which is added with EVA having a melt flow rate of 15, and that of Example 2 which is added with EVA2 having a melt flow rate of 6, are equal to or less than 115 to exhibit good workability. Therefore, it is preferred that the melt flow rate of the adhesion inhibitor of uncross-linked rubber is equal to or more than 5.

On the contrary, as shown in TABLE 3, in the case of Comparative Examples 1 and 2, in which the contents of EVA1 and EVA3 are 2 and 2.5% by weight, the adhesive strength of uncross-linked molded bodies is equal to or more than 22 N to be over 15 N which is a target level to result in no trouble in practice.

Furthermore, in the case of Comparative Examples 3 and 4, in which the contents of EEA1 and EEA2 are more to be 50% by weight and 60% by weight, the compressive permanent set is equal to or more than 50 to result in problem in practice.

From the abovementioned results, it is understood that the content of the adhesion inhibitor of uncross-linked rubber is 5 to 40% by weight to suppress the adhesion among uncross-linked molded bodies and the compressive permanent set are suppressed. Furthermore, the content of ethylene included in the adhesion inhibitor of uncross-linked rubber is equal to or more than 70% by weight can suppress the adhesion among uncross-linked molded bodies, and the melt flow rate of the adhesion inhibitor of uncross-linked rubber is equal to or more than 5 to realize low Mooney viscosity which makes it possible to improve the workability.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A composition of conductive rubber including carbon for conductive additive in base rubber to be cross-linkable by electron beam radiation, comprising:

5 to 40% by weight of an adhesion inhibitor of uncross-linked rubber which includes any of ethylene ethyl acrylic acid copolymer resin (EEA), ethylene vinyl acetate copolymer resin (EVA), ethylene methyl acrylate copolymer resin (EMA), and ethylene acrylic acid copolymer resin (EAA), wherein the adhesion inhibitor has a melt rate equal to or more than 5 and the composition has adhesive strength greater than about 7.5 N at 50 mm/min and a compressive permanent set of greater than about 39 at about 150° C. and 25% compression left for about 22 hours.

2. The composition of conductive rubber according to the claim 1, wherein a content of ethylene in the adhesion inhibitor of uncross-linked rubber is equal to or more than 70% by weight.

3. The composition of conductive rubber according to claim 1, wherein the composition has an adhesive strength greater than about 7.5 N at 50 mm/min, a compressive permanent set of greater than about 39 at 150° C. and 25% compression left for 22 hours and a Mooney viscosity below about 120 at 180° C.

* * * * *